United States Patent [19]

Goans

[11] 4,442,757

[45] Apr. 17, 1984

[54] FLUID PRESSURE ACTUATOR HAVING BIAS ELEMENT IMMERSED IN NON-CORROSIVE ENVIRONMENT

[75] Inventor: Kip B. Goans, Harvey, La.

[73] Assignee: Baker CAC, Inc., Belle Chasse, La.

[21] Appl. No.: 295,449

[22] Filed: Aug. 24, 1981

[51] Int. Cl.[3] ..... F01B 31/18

[52] U.S. Cl. ..... 92/82; 92/77; 92/130 B; 92/174

[58] Field of Search ..... 92/130 B, 130 R, 130 A, 92/130 C, 130 D, 131, 82, 77, 86.5, 174; 137/536; 251/62

[56] References Cited

U.S. PATENT DOCUMENTS

| | | | |
|---|---|---|---|
| 1,481,011 | 1/1924 | Joyce | 92/174 |
| 2,349,345 | 5/1944 | Goepfrich | 92/174 |
| 2,817,361 | 12/1957 | Mercier | 92/82 |
| 3,142,157 | 7/1964 | Firth et al. | 92/130 B |
| 3,905,278 | 9/1975 | Ourdouillie | 92/82 |

*Primary Examiner*—Paul E. Maslousky

*Attorney, Agent, or Firm*—Norvell & Associates

[57] ABSTRACT

An improved valve actuator is provided for employment in environments such as subterranean wells where highly corrosive gases and fluids are contained in the well fluid which is normally pressurized and employed to operate the actuator. The bias element opposing the pressure induced movements of the piston unit of the actuator is disposed in an isolation chamber defined between two axially spaced, radial shoulders provided on the piston and having sealing engagement with the bore of the cylindrical wall, thus defining constant volume annular chamber that is isolated from the highly corrosive fluids and gases. The isolated chamber moves with the piston and thus does not provide fluid pressure opposition to the fluid pressure induced movement of the piston.

8 Claims, 2 Drawing Figures

FLUID PRESSURE ACTUATOR HAVING BIAS ELEMENT IMMERSED IN NON-CORROSIVE ENVIRONMENT

BACKGROUND OF THE INVENTION

1. Field of the Invention

The invention relates to a fluid pressure acutator that is specifically designed to operate in an environment involving fluids that attack metals either corrosively or by inducing stress corrosion cracking. Such environment is commonly found in actuators for oil field equipment.

2. Description of the Prior Art

Fluid pressure actuators are employed in a large variety of equipment for pipelines, subterranean wells, and the like. Such actuators are normally fluid pressure actuated to move a valve member to an open position and move the valve to a closed position by a highly compressed bias member. It is vitally important that such bias member retain all of its designed compressive force and that it not deteriorate or break under the severe environmental conditions to which such actuators are commonly subjected.

As is well known to those skilled in the art, such equipment is subjected to the combined hostile environment of $H_2S$, $CO_2$ and/or various chlorides. The most effective and economical metals to employ for high compression springs for such actuators are various carbon steels, which are subject to relatively rapid failure either through corrosion, stress corrosion cracking or fatigue when required to continuously operate in the aforementioned hostile environment. The problem has been sufficiently serious that prior art attempts to solve it have involved the expensive use of more exotic and scarce metals for the springs or installing a control system that uses the pressurized corrosive fluid to pressurize non-corrosive and uncontaminated hydraulic oil. This necessarily means that highly corrosive well fluids can never be utilized as a source of control fluid pressure and that either a supply of non-corrosively treated oil is maintained at the well head, or expensive apparatus for separating the corrosive elements from the well fluids is maintained at the well head. Neither expedient is economically attractive.

Thus, there is a definite need for a fluid pressure actuator which provides protection for the highly compressed, carbon steels springs of such actuator from the hostile environment normally encountered in exposure to fluids produced from a subterranean well, without necessitating the utilization of a corrosive-free control fluid oil or the treatment of well fluids to remove the corrosive elements prior to application to the actuator or exotic spring materials that are immune to corrosive effects of well fluids.

SUMMARY OF THE INVENTION

The invention provides an improved fluid pressure actuator wherein the pressure induced movement of the actuator may be produced by pressurized well fluids and is opposed by a highly stressed compressive spring. The spring, however, is not exposed to the control fluid for the actuator, but instead is disposed in an annular chamber defined between the piston shaft and the interior cylindrical wall of the body or housing of the actuator. Such annular chamber is movable with the piston shaft and hence maintains a constant volume, regardless of the axial position of the piston shaft relative to the body of the actuator. Such annular housing is filled either at the factory or at the well head with a corrosion resistant fluid which will insure the protection of the highly stressed carbon steel spring mounted within the annular chamber and operates between an interior shoulder provided on the wall of the housing and a radial shoulder provided on the piston shaft. Thus, regardless of the existence of corrosive fluids in the well fluids which are operating upon a piston face carried by the piston shaft, the well fluids never come in contact with the highly compressed spring.

DESCRIPTION OF THE PREFERRED EMBODIMENTS

Figure 1:
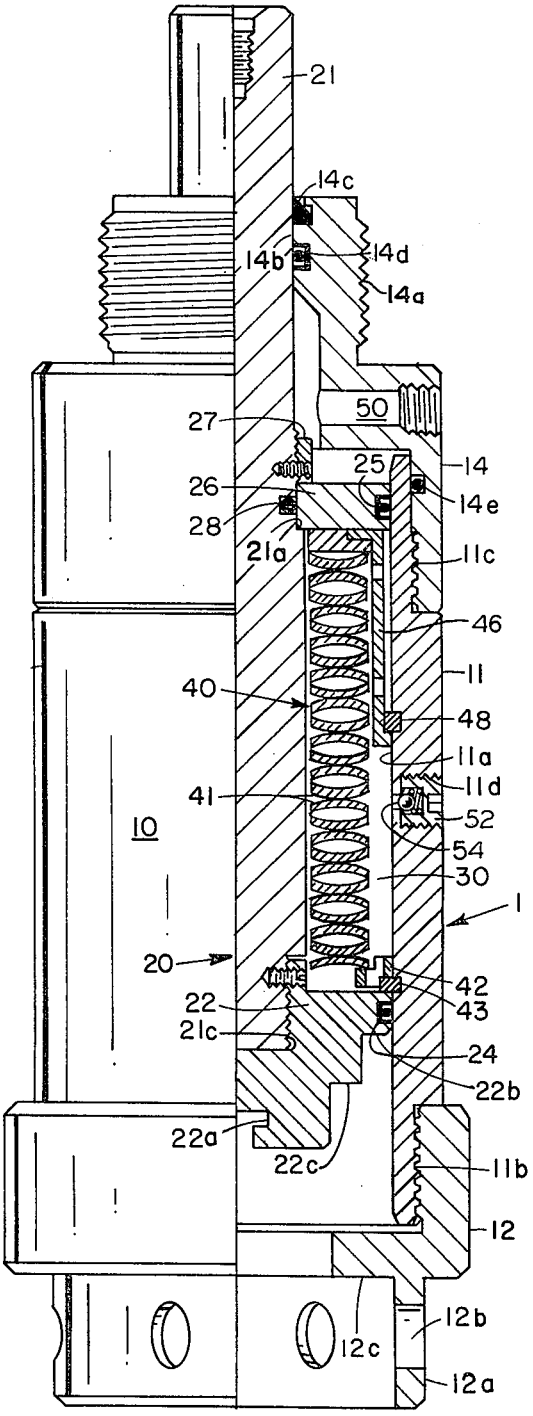
FIG. 1 is a sectional view of a fluid pressure actuator incorporating this invention, with the elements of the actuator shown in the positions prior to the application of any actuating fluid pressure.
Figure 2:
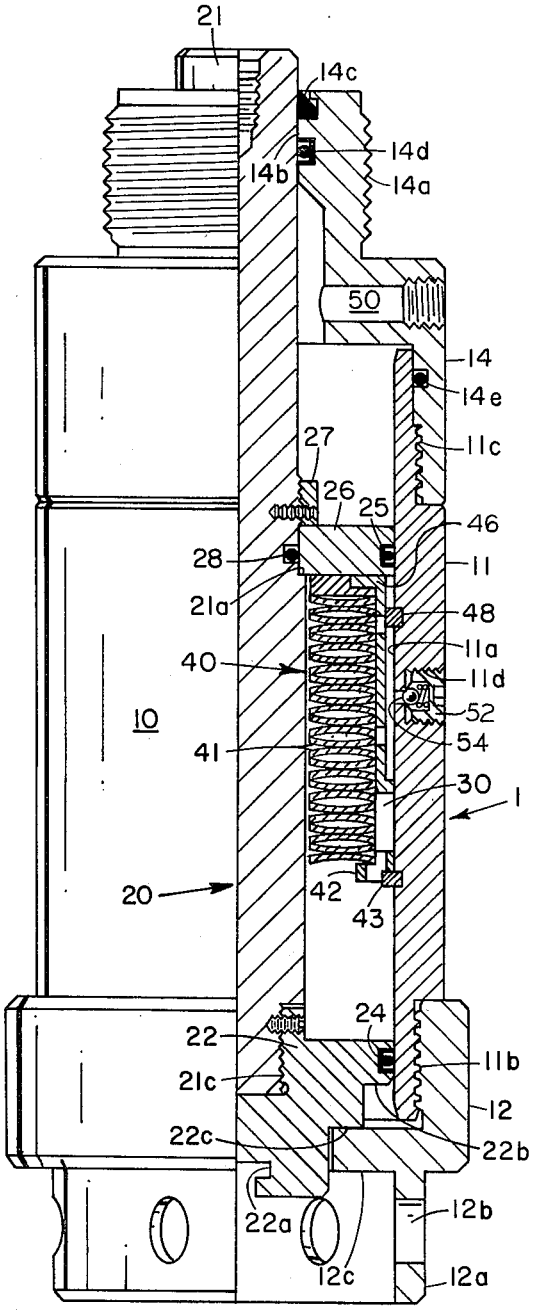
FIG. 2 is a view similar to FIG. 1 but showing the elements in the positions occuppied in the actuator after the application of an actuating fluid.

Referring to FIG. 1, there is disclosed a fluid pressure actuator 1 incorporating a spring opposing movement of the piston of the acutator, said spring being completely immersed in a corrosive protecting fluid contained in an isolated and constant volume chamber. Such actuator includes a hollow body portion 10 formed by the threaded assemblage of a body cylinder 11 by threads **11*b* at one end to a cylinder base 12 and at the other end by threads 11*c* to a cylinder head 14**.

Cylinder base 12 is provided with an axially extending, annular flange **12*a* which is adapted for securement to the bonnet ring of well known types of safety valves through the insertion of a plurality of bolts (not shown) through raidal holes 12*b* provided in flange 12*a*. Cylinder head 14 is provided with a reduced diameter end portion 14*a* which defines an internal sliding bore surface 14*b* for journalling the shaft 21 of a piston assembly 20 for relative axial sliding movement. Appropriate fluid sealing and wiping seals 14*d* and 14*c*, respectively, are conventionally provided in the bore surface 14*b* of bearing sleeve 14. An O-ring seal 14*e* prevents fluid leakage between body cylinder 11 and cylinder head 14**.

Piston assembly 20 includes, in addition to the central shaft 21, a piston element 22 having an annular portion which is threadably secured by threads **21*c* to the bottom end of piston shaft 21. Piston element 22 thus constitutes a radially projecting shoulder on shaft 21. Piston element 22 defines at its bottom end a T slot 22*a* for detachably connecting to the stem (not shown) of a valve, such as a valve on a production conduit. Additionally, the piston element 22 is formed with a radially projecting piston shoulder portion 22*b* which has a sliding engagement with the inner wall 11*a* of the body cylinder 11. A suitable fluid seal 24 is mounted in an annular recess provided in the peripheral surface of the piston shoulder portion 22*b***.

At an axially spaced distance above the piston shoulder portion **22*b*, an upper piston element 26 is provided, comprising an annular member which is seated on an upwardly facing shoulder 21*a* formed by an enlarged diameter portion of the shaft 21. Piston element 26 thus constitutes a second radially projecting shoulder on shaft 21. Upper piston element 26 is secured in abutment with piston shaft shoulder 21*a* by a nut 27 which is secured to suitable threads on shaft 21. A seal 28 prevents fluid leakage between shaft 21 and the inner wall of the annular piston shoulder 26**.

The outer periphery of piston shoulder 26 is in sliding engagement with the bore 11*a* of the body cylinder 11 and mounts a seal 25 for effecting a fluid sealing engagement therewith. Thus, there is defined between the shaft 21 of the piston assembly 20 and the inner wall 11*a* of the body cylinder 11, an annular chamber 30 of constant volume and which is completely isolated from any fluids operating on the exterior faces of the piston elements 22 and 26.

A compression spring 40, which opposes downward movement of the piston assembly 20 is mounted within the isolation chamber 30. The lower end of the spring 40 is supported by an annular spring support 42 which is in turn supported by a C-ring 43 inserted in an appropriate slot provided in the bore 11*a* of the body cylinder 11. The upper end of spring 40 bears against the radial portion of an annular spring housing 46, which, in turn, bears against the bottom face of the upper piston element 26. Thus, downward movement of the piston assemblage 20 is opposed by compression of spring 40.

In order to achieve very high compressive forces with relatively little movement, the spring 40 preferably comprises a stack of annular disc-type spring elements 41. The downward movement of the piston assembly 20 is limited by the contact of radial shoulder 22*c* with the inwardly extending shoulder 12*c* on base 12. Upward movement of the piston assembly is limited by contact of outside periphery shoulder of the annular spring housing 46 with C-ring 43.

Fluid pressure is applied to the upper face of the upper piston element 26 through a radially disposed port 50. In oil well applications, the pressurized fluid utilized to effect the actuation of the piston is generally well fluids containing highly corrosive elements such as $H_2S$, $CO_2$ and various chloride compositions. This fluid is completely effective to move the piston assembly 20 downwardly, and thus achieve the actuation of the safety valve or any other type of valve to which it is connected, but it will be noted that the well fluids operating on the piston face provided by the shoulder 26 are completely isolated from the chamber 30 containing the spring 40. Thus, the disc spring units 41 may be fabricated from carbon steels, which are both econimical and highly effective, and such elements are completely protected from contact with corrosive fluids.

The filling of isolation chamber 30 with fluid may be accomplished at the factory or at the well head through a radial port 11*d* provided in the wall of body sleeve 11. After filling, the port 11*d* may be closed by a plug, but, as illustrated, it is preferably closed by a plug 52 containing a ball-type check valve 54 which will function to release any excess pressure that might be generated in the isolation chamber 30 due to thermal expansion of the fluid.

It will therefore be apparent to those skilled in the art that the aforedescribed construction provides completely dependable spring opposition to fluid pressure induced movements of a piston wherein well fluids containing corrosive elements are employed to move the piston, but the springs are disposed in an isolation chamber which moves with the piston and is completely filled with a corrosion protecting oil, thus insuring that the corrosive elements never come in contact with the spring elements.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A fluid actuator, comprising: a hollow body defining a fluid pressure chamber having a cylindrical internal wall; a piston shaft mounted in said hollow body for axially slidable movement within said fluid pressure chamber; a pair of axially spaced, radially projecting shoulders on said piston shaft; sealing means on the peripheries of said shoulders for respectively slidably sealingly engaging said cylindrical internal wall, thereby defining an annular chamber surrounding and movable with said piston shaft and adapted to contain a corrosion protection fluid; biasing means disposed in said annular chamber, one end of said biasing means abutting a radial surface on one of said piston shaft shoulders; support means secured to said cylindrical internal wall within said annular chamber and engaging the other end of said biasing means; a radial piston face on said piston shaft exteriorly of said annular chamber; and fluid conduit means in said body for applying fluid pressure to said piston face to move said piston shaft axially relative to said hollow body in a direction to energize said biasing means without changing the volume of said annular chamber.

2. A fluid actuator, comprising: a hollow body defining a fluid pressure chamber having a cylindrical internal wall; said internal wall having an annular abutment formed thereon; a piston shaft mounted in said hollow body for axially slidable movement within said fluid pressure chamber; at least one pair of axially spaced, radially projecting shoulders on said piston shaft; sealing means on the periphery of each said shoulder for slidably sealingly engaging said cylindrical internal wall, thereby defining an annular chamber intermediate said shoulders surrounding and movable with said piston shaft and adapted to contain a corrosive protection fluid; biasing means disposed in said annular chamber, one end of said biasing means abutting said annular abutment on said cylindrical internal wall; a radial surface on said piston shaft within said annular chamber engaging the other end of said biasing means; a radial piston face on said piston shaft exteriorly of said annular chamber; and fluid conduit means in said body for applying fluid pressure to said piston face to move said piston shaft axially relative to said hollow body in a direction to energize said biasing means without changing the volume of said annular chamber.

3. A fluid actuator, comprising: a hollow body defining a fluid pressure chamber having a cylindrical internal wall; a piston shaft mounted in said hollow body for axially slidable movement within said fluid pressure chamber, one portion of said piston shaft disposed in said fluid pressure chamber being of a diameter less than said cylindrical internal wall; a pair of axially spaced, radially projecting shoulders on said one piston shaft portion; sealing means on the peripheries of said shoulders for respectively slidably sealing engaging said cylindrical internal wall, thereby defining an annular chamber surrounding and movable with said piston shaft and adapted to contain a corrosion protection fluid; biasing means disposed in said annular chamber, a radial surface on one of said shoulders abutting one end of said biasing means; support means secured to said cylindrical internal wall within said annular chamber and engaging the other end of said biasing means; a piston face on one of said shoulders located exteriorly of said annular chamber; and fluid conduit means in said body for applying fluid pressure to said piston face to move said piston shaft axially relative to said hollow body in a direction to energize said biasing means without changing the volume of said annular chamber.

4. The apparatus of claim 1, 2 or 3 wherein one of said radially projecting shoulders on said piston shaft defines said piston face that is subjected to fluid pressure.

5. The apparatus of claim 1, 2 or 3 wherein one of said radially projecting shoulders on said piston shaft has one radial face defining said radial surface in said annular chamber that engages said one of said biasing means, and another radial face defining said piston face that is subjected to fluid pressure.

6. A fluid actuator, comprising: a hollow body defining a fluid pressure chamber having a cylindrical internal wall; a piston shaft of smaller diameter than said cylindrical internal wall; means for mounting at least one end portion of said piston shaft in said hollow body for axially slidable movement within said fluid pressure chamber; a pair of axially spaced, radially projecting shoulders on said piston shaft; sealing means on the peripheries of said shoulders for respectively slidably, sealingly engaging said cylindrical internal wall, thereby defining an annular chamber surrounding and movable with said piston shaft and adapted to contain a corrosion protecting fluid; one of said shoulders having a generally radially disposed side wall forming part of said annular chamber; an annular compression spring disposed in said annular chamber in surrounding relationship to said piston shaft, one end of said annular compression spring abutting said radially disposed side wall of said one shoulder; an annular spring seat secured to said cylindrical internal wall within said annular chamber and engaging the other end of said annular spring; and fluid conduit means in said body for supplying corrosive fluid to the other side wall of said one shoulder to move said piston shaft axially relative to said hollow body in a direction to compress said annular spring without changing the volume of said annular chamber, whereby said annular spring is continuously immersed in a corrosion protecting fluid.

7. The apparatus of claim 1, 2, 3 or 4 further comprising a pressure relief valve disposed intermediate said annular chamber and the exterior of said body, said check valve permitting fluid flow out of said annular chamber only to relieve any excess pressure developed therein.

8. The apparatus of claim 6 wherein the commpression spring disposed in said annular chamber comprises a stack of disc spring washers.

* * * * *